US008083874B2

(12) United States Patent
Ueta et al.

(10) Patent No.: US 8,083,874 B2
(45) Date of Patent: Dec. 27, 2011

(54) METHOD FOR PRODUCING LOW THERMAL EXPANSION NI-BASE SUPERALLOY

(75) Inventors: Shigeki Ueta, Nagoya (JP); Toshiharu Noda, Nagoya (JP); Ryuichi Yamamoto, Takasago (JP); Yoshikuni Kadoya, Takasago (JP); Ryotaro Magoshi, Takasago (JP); Shin Nishimoto, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 456 days.

(21) Appl. No.: 11/115,159

(22) Filed: Apr. 27, 2005

(65) Prior Publication Data

US 2005/0236079 A1 Oct. 27, 2005

(30) Foreign Application Priority Data

Apr. 27, 2004 (JP) ..... P.2004-132135

(51) Int. Cl.
*C22F 1/10* (2006.01)
*C22C 19/05* (2006.01)

(52) U.S. Cl. ..... 148/675; 420/449

(58) Field of Classification Search ..... 148/675; 420/449

See application file for complete search history.

(56) References Cited

U.S. PATENT DOCUMENTS

| | | | | |
|---|---|---|---|---|
| 3,898,109 | A | 8/1975 | Shaw | |
| 4,161,412 | A * | 7/1979 | Henry | 148/675 |

FOREIGN PATENT DOCUMENTS

| | | | |
|---|---|---|---|
| EP | 1035225 | A1 | 9/2000 |
| EP | 1096033 | A1 | 5/2001 |
| EP | 1191118 | A1 | 3/2002 |
| JP | 0674224 | A | 3/1994 |
| JP | 7011405 | A | 1/1995 |
| JP | 2000-256770 | | 9/2000 |
| JP | 2002088455 | | 3/2002 |
| JP | 2003-13161 | | 1/2003 |

OTHER PUBLICATIONS

G. Shen, D. Furrer: Manufacturing of Aerospace Forgings, Journal of Material Processing Technology, 98, 2000, pp. 189-195.*

* cited by examiner

*Primary Examiner* — Jessee R. Roe
(74) *Attorney, Agent, or Firm* — Bacon & Thomas, PLLC

(57) ABSTRACT

A method for producing a low thermal expansion Ni-base superalloy including the steps of subjecting the alloy to a solution heat treatment under the condition of at a temperature of 1000 to 1200° C. and subjecting the alloy to either a carbide stabilizing treatment for making aggregated carbides on grain boundaries and stabilizing the carbides under the conditions of at a temperature of not less than 850° C. and less than 1000° C. and for 1 to 50 hours, or a carbide stabilizing treatment for making aggregated carbides on grain boundaries and stabilizing the carbides by cooling from the temperature in the solution heat treatment to 850° C. at a cooling rate of 100° C. or less per hour. The method also including the steps of subjecting the alloy to a first aging treatment for precipitating y' phase under the conditions of at a temperature of 720 to 900° C. and for 1 to 50 hours, and subjecting the alloy to a second aging treatment for precipitating $A_2B$ phase under the conditions of at a temperature of 550 to 700° C. and for 5 to 100 hours.

14 Claims, 2 Drawing Sheets

1150 °C x 2h/WATER-COOLING
+ AG0 + AG1 + AG2

1150 °C x 2h/FURNACE-COOLING
+ AG1 + AG2

1050 °C x 2h/WATER-COOLING
+ AG1 + AG2

AG0: 950 °C x 5h/AIR-COOLING
AG1: 750 °C x 16h/AIR-COOLING
AG2: 650 °C x 24h/AIR-COOLING

METHOD FOR PRODUCING LOW THERMAL EXPANSION NI-BASE SUPERALLOY

FIELD OF THE INVENTION

This invention relates to a method for producing a low thermal expansion Ni-base superalloy, for example, a low thermal expansion Ni-base superalloy showing low thermal expansion and having an excellent creep fracture resistance at high temperatures, preferable as a casing joint bolt of a steam turbine or a gas turbine to be used at a high temperature range of 650° C. or more.

BACKGROUND OF THE INVENTION

As the casing of a steam turbine or a gas turbine, 12 Cr ferritic steel having low thermal expansion coefficient compared with Ni-based alloys has been mainly used.

However, in recent years, for the improvement of the thermal efficiency, for example, a development has been pursued so that the steam temperature is increased to 650° C. or more in a steam turbine.

As the steam temperature thus becomes higher, the heat-resisting strength required of the casing also increases accordingly. However, for such a casing, it is possible for example to meet the requirement by increasing its thickness.

As the joint bolt for joining the casing, 12 Cr ferritic steel has been used as in the case of the casing. In the case of the joint bolt of the casing, the bolt can meet the requirement by increasing in size with an increase in temperature. However, this approach has a limitation, which necessitates the use of the one having a high heat-resisting strength at a higher temperature in terms of the material.

Examples of the materials therefore include austenitic Ni-base superalloys (e.g., Refractaloy 26 (trade name of Westinghouse So.)) having more excellent corrosion resistance and oxidation resistance, and higher high-temperature strength than those of the 12 Cr ferritic steels.

However, these have excellent high-temperature strength, but have a high thermal expansion coefficient. For this reason, the difference in thermal expansion from the casing of 12 Cr ferritic steels causes loosening of the bolt at high temperature, which may cause steam leakage.

The following references 1 and 2 each relate to a low thermal expansion Ni-base superalloy developed from such a viewpoint.

The Ni-base superalloy has been developed with the aim of making a superalloy having a thermal expansion coefficient close to that of the 12 Cr ferritic steel while keeping the high-temperature strength.

[Reference 1] JP 2003-13161 A

[Reference 2] JP 2000-256770 A

The present invention has been completed for the purpose of providing a method for producing a low thermal expansion Ni-base superalloy which has been further improved in creep fracture strength than the low thermal expansion Ni-base superalloys in the references 1 and 2, and which has a higher creep fracture strength under a high temperature atmosphere that is required for the joint bolt of a steam turbine etc.

SUMMARY OF THE INVENTION

The present inventors have made eager investigation to examine the problem. As a result, it has been found that the foregoing objects can be achieved by the following method for producing a low thermal expansion Ni-base superalloy. With this finding, the present invention is accomplished.

The present invention is mainly directed to a method for producing a low thermal expansion Ni-base superalloy, which comprises: preparing an alloy comprising, by weight %, C: 0.15% or less, Si: 1% or less, Mn: 1% or less, Cr: 5 to 20%, at least one of Mo, W and Re, which satisfy the relationship Mo+½(W+Re): 17 to 27%, Al: 0.1 to 2%, Ti: 0.1 to 2%, Nb and Ta, which satisfy the relationship Nb+Ta/2: 1.5% or less, Fe: 10% or less, Co: 5% or less, B: 0.001 to 0.02%, Zr: 0.001 to 0.2%, a reminder of Ni and inevitable components; subjecting the alloy to a solution heat treatment under the condition of at a temperature of 1000 to 1200° C.; subjecting the alloy to either a carbide stabilizing treatment for making aggregated carbides on grain boundaries and stabilizing the carbides under the conditions of at a temperature of not less than 850° C. and less than 1000° C. and for 1 to 50 hours, or a carbide stabilizing treatment for making aggregated carbides on grain boundaries and stabilizing the carbides by cooling from the temperature in the solution heat treatment to 850° C. at a cooling rate of 100° C. or less per hour; subjecting the alloy to a first aging treatment for precipitating γ' phase under the conditions of at a temperature of 720 to 900° C. and for 1 to 50 hours; and subjecting the alloy to a second aging treatment for precipitating $A_2B$ phase under the conditions of at a temperature of 550 to 700° C. and for 5 to 100 hours.

DETAILED DESCRIPTION OF THE INVENTION

The alloy in the reference 1 is obtained in the following manner. In producing a low thermal expansion Ni-base superalloy, a material is subjected to a solution heat treatment. Then, a first aging treatment and a second aging treatment are carried out thereon. Thereby, γ' phase ($Ni_3(Al, Ti)$) is precipitated with the first aging treatment. Then, $A_2B$ phase ($Ni_2(Mo, Cr)$) is precipitated with the second aging treatment. As a result, the high-temperature strength is achieved.

In contrast, the invention is characterized in the following: after a solution heat treatment, either a carbide stabilizing treatment for making aggregated carbides on grain boundaries and stabilizing the carbides under the conditions of at a temperature of not less than 850° C. and less than 1000° C. and for 1 to 50 hours, or a carbide stabilizing treatment for making aggregated carbides on grain boundaries and stabilizing the carbides by cooling from the temperature in the solution heat treatment to 850° C. at a cooling rate of 100° C. or less per hour is performed; and further the first aging treatment to precipitate γ' phase and the subsequent second aging treatment to precipitate $A_2B$ phase under the foregoing conditions are performed, thereby to precipitate γ' phase and $A_2B$ phase; as a result, the high-temperature strength, specifically, the creep rupture resistance at high temperatures is still further enhanced.

Herein, the carbide stabilizing treatment has a meaning of strengthening the grain boundaries.

The creep under a high temperature environment in a low thermal expansion Ni-base superalloy is a phenomenon in which the material deforms due to sliding at the grain boundaries under a load stress applied.

Therefore, strengthening of the grain boundaries can enhance the high-temperature creep rupture strength.

Figure 1B:
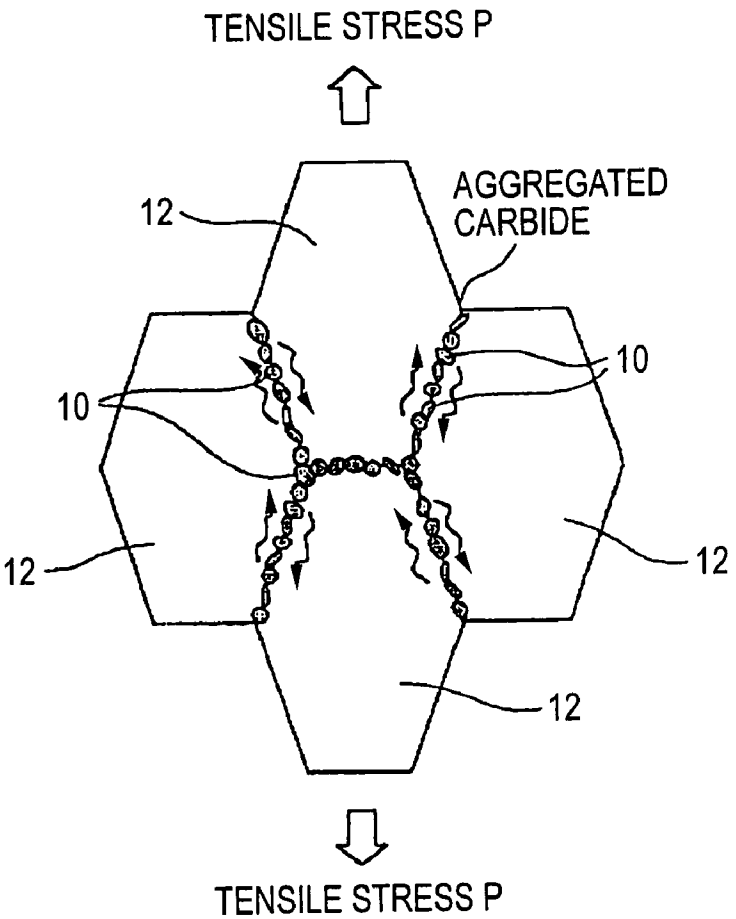
FIGS. 1A and 1B are schematic views showing the principle of the improvement of the high-temperature strength of a low thermal expansion Ni-base superalloy in accordance with the invention together with Comparative Example.
Figure 1A:
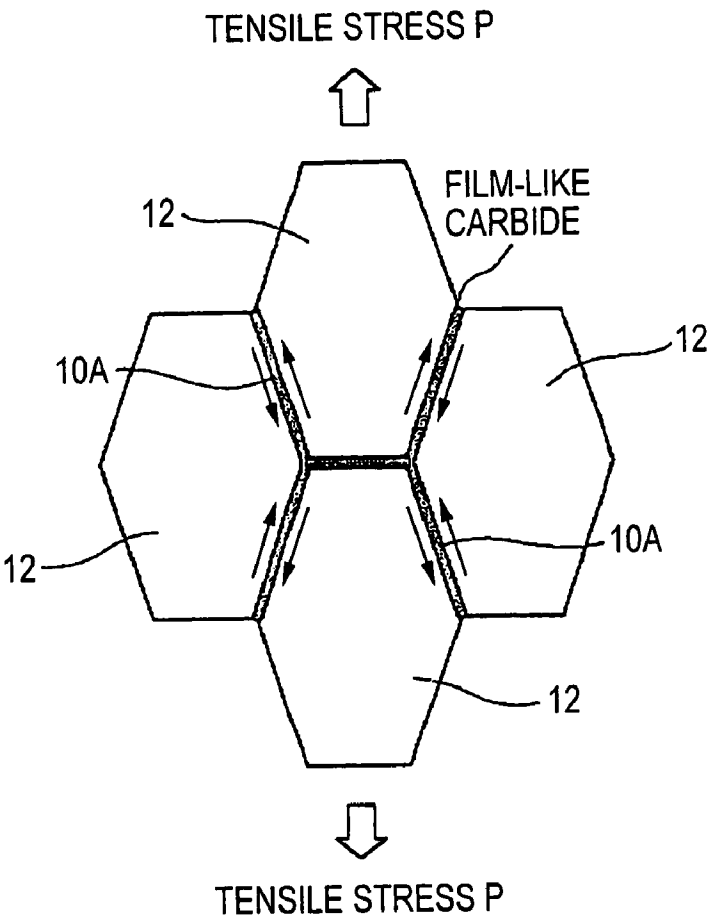

In this regard, for the low thermal expansion Ni-base superalloy in background arts or the low thermal expansion Ni-base superalloy in the reference 1, as shown in a schematic view of FIG. 1A, the carbide present at the grain boundaries between grains 12 is in the form of a film (film-like carbide 10A)

When the carbide present at the grain boundaries is in the form of a film, grains 12 and grains 12 tend to slide on each other along the grain boundaries. This causes a reduction of the creep rupture strength under a high-temperature environment.

In contrast, in the invention, attention is directed to the fact that such a carbide in the form of a film has a tendency to mutually agglomerate and to become stabilized in aggregated form under given conditions. Thus, by applying a prescribed heat treatment, the carbide in the form of a film is made aggregatus as shown in FIG. 1B, or when a carbide is precipitated at the grain boundaries, it is precipitated into aggregated form (aggregated carbide 10).

When the carbide present at the grain boundaries is in such aggregated form, the carbide in aggregated form becomes a large resistance to the sliding and/or the creep crack propagation when the grain boundary sliding occurs. As a result, the sliding and/or the creep crack propagation at the grain boundaries is suppressed, so that the creep rupture strength under a high-temperature environment is effectively enhanced.

A gist of the invention resides in that the high-temperature strength of a low thermal expansion Ni-base superalloy is enhanced through the transgranular strengthening by the precipitation of γ' phase and $A_2B$ phase, and the intergranular strengthening by control of the form of the grain boundary carbide.

Incidentally, the term "aggregated form" for a carbide denotes the form of elliptic or round grains, which are arranged in individual states along the grain boundaries.

The invention can provide a low thermal expansion Ni-base superalloy having higher high-temperature strength than in the background art.

Then, the reasons for restricting each component and the treatment conditions in the invention will be described below. Hereinafter, amount of each component is by weight % unless otherwise denoted.

Components

C: 0.15% or Less

C combines with Ti, Nb, Cr, and Mo in an alloy to form carbides. This enhances the high-temperature strength, and prevents the coarsening of grains. Further, it is an important element also for precipitating a grain boundary carbide.

However, when the C content exceeds 0.15%, the hot workability of the alloy is reduced. For this reason, the C content is preferably set at 0.15% or less, more preferably 0.10% or less.

Si: 1% or Less

Si is added as a deoxidizer during alloy melting, and the contained Si improves the oxidation resistance of the alloy.

However, when the Si content exceeds 1%, the ductility of the alloy is reduced. For this reason, the Si content is preferably set at 1% or less, more preferably 0.5% or less.

Mn: 1% or Less

Mn is added as a deoxidizer during alloy melting as with Si.

When the Mn content exceeds 1%, not only the oxidation resistance at high temperatures of the alloy is degraded, but also the precipitation of the η phase ($Ni_3Ti$) detrimental to ductility is promoted. For this reason, the Mn content is preferably set at 1% or less, more preferably 0.5% or less.

Cr: 5 to 20%

Cr is solid-solved in the austenite phase to improve the high-temperature oxidation resistance and the corrosion resistance of the alloy.

In order for the alloy to hold the sufficient high-temperature oxidation resistance and corrosion resistance, a larger Cr content is more desirable. On the other hand, a smaller Cr content is more desirable from the viewpoint of thermal expansion because Cr increases the thermal expansion coefficient of the alloy.

In order to obtain the thermal expansion coefficient suitable at the operating temperature of a steam turbine, the Cr content is preferably set at 5 to 20%. In order to obtain a further lower thermal expansion coefficient, the Cr content is preferably set at 5 to 15%, more preferably 5 to 10%. A Cr content of 5 to 10% results in a still further lower thermal expansion coefficient.

Mo+½(W+Re): 17 to 27%

Mo, W, and Re are solid-solved in an austenite phase, and thereby improve the high-temperature strength of the alloy by the solid solution strengthening, and reduce the thermal expansion coefficient of the alloy. The value of Mo+½(W+Re) is preferably set at 17% or more in order to obtain a preferred thermal expansion coefficient.

Further, they cause the precipitation of grain boundary carbides and an intermetallic compound of $A_2B$ phase ($Ni_2(Cr, Mo)$), and improve the creep rupture strength.

On the other hand, when the value of Mo+½(W+Re) exceeds 27%, the hot workability is reduced, and further, a brittle phase is precipitated, resulting in a reduction of the ductility. For this reason, the upper limit value of Mo+½(W+Re) is preferably set at 27%.

Al: 0.1 to 2%

Al is a main metallic element which combines with Ni to form γ' phase ($Ni_3Al$). When the Al content is less than 0.1%, the precipitation of the γ' phase becomes not sufficient. When Ti, Nb, and Ta are present in large quantities with a low Al content, the γ' phase becomes unstable, and the η phase or the δ phase is precipitated to cause embrittlement.

On the other hand, when the Al content exceeds 2%, the hot workability is reduced, and forging into a part becomes difficult. For this reason, When the Al content is preferably set at 0.1 to 2%, more preferably 0.1 to 0.4%.

Ti: 0.1 to 2%

As with Al, Ti combines with Ni to form γ' phase ($Ni_3(Al, Ti)$), and causes the precipitation strengthening of the alloy. Further, Ti reduces the thermal expansion coefficient of the alloy, and promotes the precipitation strengthening of the γ' phase. In order to obtain such effects, Ti is required to be contained in an amount of 0.1% or more.

On the other hand, when Ti is contained in an amount of more than 2%, the strength is too much enhanced by the combined precipitation strengthening of the $A_2B$ phase and the γ' phase, and the notch sensitivity increases. For this reason, the Ti content is controlled to 2% or less. The more desirable range of the Ti content is 0.1 to 0.9%, Nb+Ta/2: 1.5% or less Nb and Ta form γ' phase which is an intermetallic compound with Ni, and strengthen the γ' phase itself as with Al and Ni. Nb and Ta further have an effect of preventing the coarsening of the γ' phase.

However, when Nb and Ta are contained in large quantities, δ phase (intermetallic compound $Ni_3(Nb, Ta)$) precipitates in the alloy to reduce the ductility. Therefore, Nb and Ta are preferably contained in an amount of 1.5% or less in terms of the value of Nb+Ta/2. More preferably, it is set at 1.0% or less in terms of Nb+Ta/2 is set at.

Fe: 10% or Less

Fe is added for reducing the cost of the alloy, and whereas, it is contained in the alloy by using a crude ferroalloy for the mother alloy to be added for adjusting the components such as W and Mo. Fe reduces the high-temperature strength of the alloy, and increases the thermal expansion coefficient.

For this reason, a lower content thereof is more preferred. However, when it is 10% or less, the effects exerted on the high-temperature strength and the thermal expansion coefficient are small. Therefore, the upper limit value is set at 10%. It is set at preferably 5% or less, and more preferably 2% or less.

Co: 5% or Less

Co is solid-solved in an alloy to increase the high-temperature strength of the alloy. Such effects are smaller as compared with other elements (solid solution strengthening generating elements). Co is expensive, and hence, the Co content is preferably set at 5% or less from the viewpoint of reducing the manufacturing cost of the alloy.

B: 0.001 to 0.02%

Zr: 0.001 to 0.2%

B and Zr both segregate in the grain boundaries of the alloy to enhance the creep rupture strength of the alloy. B has an effect of suppressing the precipitation of the η phase in the alloy with a high Ti content.

However, when B is excessively contained in an alloy, the hot workability of the alloy is reduced. For this reason, the B content is set at 0.02% or less. However, a content of less than 0.001% produces small effects.

Whereas, when Zr is excessively contained, the creep rupture strength of the alloy is reduced. For this reason, the Zr content is set at 0.2% or less. However, a content of less than 0.001% produces small effects.

Ni: Reminder

Ni is a main element for forming an austenite phase which is the matrix of the alloy, and improves the heat resistance and the corrosion resistance of the alloy. Ni is further an element for forming $A_2B$ phase and γ' phase.

Heat Treatment Conditions

Solution Heat Treatment:

With a solution heat treatment, the grains are made uniform by recrystallization, and further, a carbide is solid-solved. At this step, the grain boundary carbide becomes in a film form, or it is completely solid-solved.

In the present invention, the temperature in the solution heat treatment is from 1000 to 1200° C., preferably from 1050 to 1150° C.

Carbide stabilizing treatment under the conditions of at a temperature of not less than 850° C. and less than 1000° C. and for 1 to 50 hours: or Carbide stabilizing treatment by cooling from the temperature in the solution heat treatment to 850° C. at a cooling rate of 100° C. or less per hour:

The carbide stabilizing treatment is a treatment for transforming the grain boundary carbide from film form into aggregated form. As a result, the grain boundary apparently becomes in the zigzag form, resulting in a large resistance against the grain boundary sliding and crack propagation during creep.

First aging treatment under the conditions of at a temperature of 720 to 900° C. and for 1 to 50 hours:

This is a treatment for precipitating the γ' phase for transgranular strengthening.

Second aging treatment under the conditions of at a temperature of 550 to 700° C. and for 5 to 100 hours:

This is a treatment for precipitating the $A_2B$ phase for transgranular strengthening. The $A_2B$ phase slowly precipitates. For this reason, the treatment time is set at 5 to 100 hours, and preferably 20 to 100 hours for sufficient precipitation.

In the present invention, the temperature in the second aging treatment is from 550 to 700° C., preferably from 600 to 650° C.

EXAMPLES

The present invention is now illustrated in greater detail with reference to Examples and Comparative Examples, but it should be understood that the present invention is not to be construed as being limited thereto.

Then, Embodiments of the present invention will be described in details below.

The alloys of the compositions shown in Table 1 were vacuum melted, and cast into 50-kg ingots.

These were subjected to a homogenization treatment under the conditions of at 1200° C. and for 16 hours, and forged to round bars having 15-mm diameter.

The round bars were subjected to the heat treatments A to F of Table 2, and a creep rupture test at 700° C.×490 MPa was carried out to evaluate the rupture life. The results are shown in Table 2 together.

TABLE 1

| | Chemical composition (weight %) | | | | | | | | | | | | | | | | | | |
|---|---|---|---|---|---|---|---|---|---|---|---|---|---|---|---|---|---|---|---|
| No. | C | Si | Mn | Fe | Co | Cr | Re | Mo | W | Ta | Nb | Al | Ti | Zr | B | Ni | Mo + 12 (W + Re) | Nb+ Ta/2 | Remarks |
| Example 1 | 0.03 | 0.12 | 0.16 | — | — | 18.2 | — | 18.5 | — | — | — | 0.52 | 0.96 | 0.03 | 0.003 | Bal. | 18.5 | — | |
| Example 2 | 0.02 | 0.15 | 0.24 | 0.21 | — | 14.5 | — | 20.4 | — | — | — | 0.50 | 1.38 | 0.02 | 0.005 | Bal. | 20.4 | — | |
| Example 3 | 0.04 | 0.08 | 0.10 | 0.16 | — | 13.1 | — | 19.0 | — | — | — | 0.61 | 1.97 | 0.06 | 0.003 | Bal. | 19.0 | — | |
| Example 4 | 0.05 | 0.25 | 0.11 | 0.34 | 1.43 | 12.6 | — | 16.3 | 4.2 | — | 0.6 | 0.90 | 1.24 | 0.05 | 0.004 | Bal. | 18.4 | 0.6 | |
| Example 5 | 0.03 | 0.17 | 0.36 | 0.50 | — | 8.4 | 1.8 | 15.6 | 5.0 | — | — | 0.79 | 1.33 | 0.01 | 0.006 | Bal. | 19.0 | — | |
| Example 6 | 0.02 | 0.13 | 0.22 | 0.37 | — | 10.9 | — | 17.8 | 5.0 | 0.6 | 0.8 | 0.43 | 1.75 | 0.04 | 0.012 | Bal. | 20.3 | 1.1 | |
| Example 7 | 0.03 | 0.21 | 0.13 | 0.65 | — | 11.7 | — | 17.2 | 4.2 | — | — | 1.22 | 0.60 | 0.02 | 0.008 | Bal. | 19.3 | — | |
| Example 8 | 0.03 | 0.19 | 0.28 | 0.48 | — | 15.3 | — | 18.9 | — | — | 0.5 | 0.38 | 1.51 | 0.03 | 0.006 | Bal. | 18.9 | 0.5 | |
| Comparative Example 1 | 0.05 | 0.13 | 0.15 | 1.3 | — | 19.2 | — | — | — | — | — | 1.46 | 2.41 | — | 0.004 | Bal. | 0 | — | Nimonic 80A |

TABLE 1-continued

| No. | Chemical composition (weight %) | | | | | | | | | | | | | | | | | | |
|---|---|---|---|---|---|---|---|---|---|---|---|---|---|---|---|---|---|---|---|
| | C | Si | Mn | Fe | Co | Cr | Re | Mo | W | Ta | Nb | Al | Ti | Zr | B | Ni | Mo + 12 (W + Re) | Nb+ Ta/2 | Remarks |
| Comparative Example 2 | 0.04 | 0.23 | 0.36 | 0.61 | 18.2 | 18.6 | — | 2.9 | — | — | — | 0.24 | 2.80 | — | 0.003 | Bal. | 2.9 | — | Refractaloy 26 |
| Comparative Example 3 | 0.02 | 0.07 | 0.06 | 24.5 | 35.8 | 3.2 | — | — | — | — | — | 5.39 | 0.21 | — | 0.003 | Bal. | 0 | — | Inconel 783 |
| Comparative Example 4 | 0.02 | 0.10 | 0.13 | 41.8 | 13.0 | — | — | — | — | — | 4.7 | 0.03 | 1.48 | — | 0.002 | Bal. | 0 | 4.7 | Incoloy 909 |

TABLE 2

| No. | Heat treatment A 1100° C. × 2 h/WC 950° C. × 5 h/AC 750° C. × 24 h/AC 650° C. × 24 h/AC | Heat treatment B 1100° C. × 2 h/WC 900° C. × 16 h/AC 800° C. × 16 h/AC 650° C. × 96 h/AC | Heat treatment C 1150° C. × 2 h → 50° C./h → 850° C. /AC 750° C. × 24 h/AC 650° C. × 96 h/AC | Heat treatment D 1100° C. × 2 h/WC 750° C. × 24 h/AC 650° C. × 24 h/AC | Heat treatment E 1100° C. × 2 h/WC 800° C. × 16 h/AC 650° C. × 96 h/AC | Heat treatment F 1150° C. × 2 h/WC 750° C. × 24 h/AC 650° C. × 96 h/AC |
|---|---|---|---|---|---|---|
| Example 1 | 438 | 400 | 462 | 260 | 242 | 288 |
| Example 2 | 461 | 429 | 493 | 283 | 250 | 310 |
| Example 3 | 493 | 468 | 517 | 306 | 284 | 332 |
| Example 4 | 510 | 486 | 539 | 325 | 303 | 364 |
| Example 5 | 596 | 557 | 624 | 451 | 417 | 480 |
| Example 6 | 488 | 444 | 514 | 364 | 331 | 392 |
| Example 7 | 457 | 429 | 490 | 312 | 299 | 345 |
| Example 8 | 475 | 452 | 505 | 297 | 266 | 323 |
| Comparative Example 1 | 162 | 120 | 181 | 79 | 38 | 99 |
| Comparative Example 2 | 231 | 163 | 257 | 125 | 97 | 151 |
| Comparative Example 3 | 103 | 78 | 121 | 36 | 25 | 63 |
| Comparative Example 4 | 78 | 51 | 88 | 23 | 11 | 50 |

Herein, for the creep rupture test, a load stress of 490 MPa was applied at 700° C., and evaluation was carried out in terms of the life until rupture. Each test piece has a 6.4-mm diameter parallel portion.

Incidentally, in Table 2, the heat treatments A, B, and C are the heat treatments in accordance with the present invention. The heat treatments D, E, and F are the heat treatments in which the carbide stabilizing treatment is not carried out.

Further, the heat treatments A and B are the heat treatments, especially the carbide stabilizing treatment is subjected under the conditions of at a temperature of not less than 850° C. and less than 1000° C. and for 1 to 50 hours. The heat treatment C is the heat treatment, especially the carbide stabilizing treatment is subjected by cooling from the temperature in the solution heat treatment to 850° C. at a cooling rate of 100° C. or less per hour.

Herein, "50° C./h→850° C./AC" in the column of the heat treatment C denotes the following process: a solution heat treatment has been carried out at 1150° C.×2 h, followed by slow cooling to 850° C. at a cooling rate of 50° C. per hour.

The comparison between the heat treatments A and D, the comparison between the heat treatments B and E, and the comparison between the heat treatments C and F of Table 2 indicate as follows: for the ones subjected to the carbide stabilizing treatment in accordance with the invention, the creep rupture life has been extended by about 100 hours as compared with the ones not subjected to the carbide stabilizing treatment; and the low thermal expansion Ni-base superalloys produced in accordance with the invention have a more excellent high-temperature strength than conventional ones.

Further, as indicated from the comparison between examples 1 to 8 and comparative examples 1 to 4, the low thermal expansion Ni-base superalloy manufactured in accordance with the invention has a more excellent high-temperature strength (creep rupture life) as compared with conventionally obtained Ni-base superalloys.

As described above, the differences between the results of the execution of the heat treatments A to C and the results of the execution of the heat treatments D to F derive from whether the carbide stabilizing treatment was carried out, or not. This is the effect produced by making the grain boundary carbide into aggregated form, thereby suppressing the grain boundary sliding and crack propagation, and effectively raising the resistance against deformation.

Figure 2A:
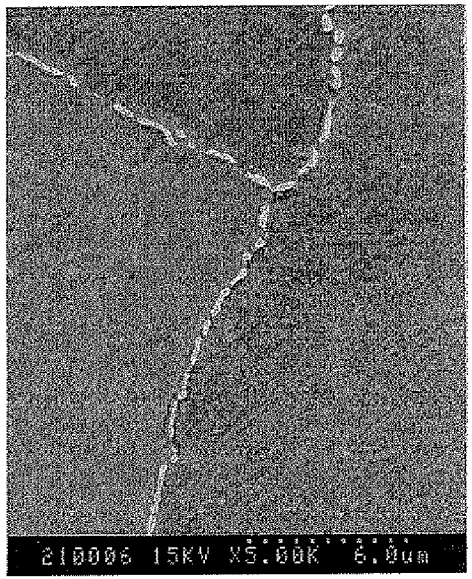
FIGS. 2A to 2C is microscopic photographs showing the carbide form at the grain boundary of a low thermal expansion Ni-base superalloy manufactured in accordance with the invention, together with Comparative Example.
Figure 2B:
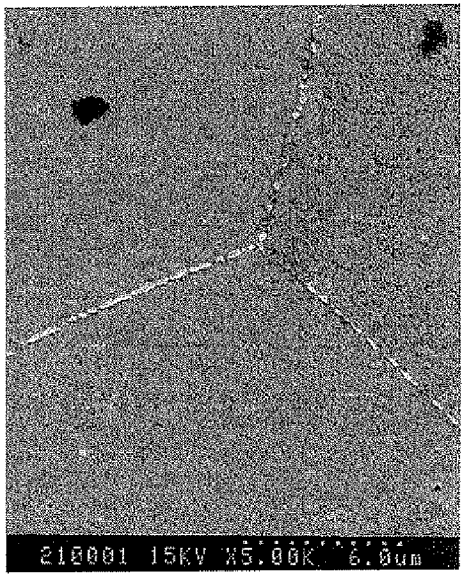

Incidentally, FIG. 2A shows a scanning electron microscopic photograph of the low thermal expansion Ni-base superalloy produced in accordance with the present invention, especially the carbide stabilizing treatment is subjected under the conditions of at a temperature of not less than 850° C. and less than 1000° C. and for 1 to 50 hours; FIG. 2B, a scanning electron microscopic photograph of the low thermal expansion Ni-base superalloy manufactured in accordance with the present invention, especially the carbide stabilizing treatment is subjected by cooling from the temperature in the solution heat treatment to 850° C. at a cooling rate of 100° C. or less per hour; and further, FIG. 2C, a scanning electron microscopic photograph of the low thermal expansion Ni-base superalloy manufactured in accordance with a conventional method.

In these photographs, the portions appearing in white are the grain boundaries. As apparent from FIGS. 2A and 2B, in the case of the low thermal expansion Ni-base superalloy produced in accordance with the invention, the carbide precipitated at the grain boundaries are a aggregated form.

Figure 2C:
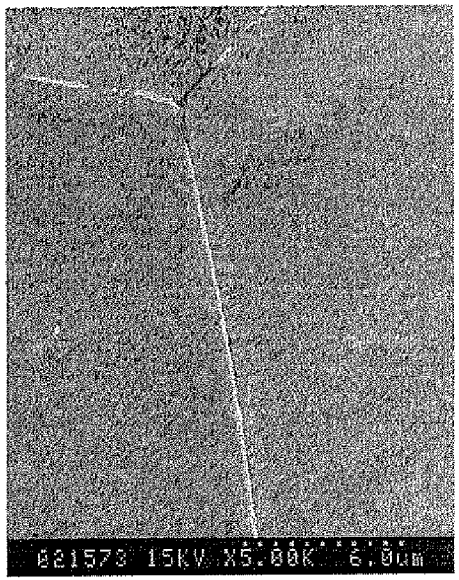

In contrast, as apparent from the photograph of FIG. 2C, in the case of the one produced by a conventional method, the grain boundary carbide assumes a film form.

Incidentally, the magnification of the scanning electron microscopic photograph is 5000 times.

Further, the specific chemical composition of the alloy of the photograph of FIG. 2A is: 12Cr-18Mo-0.9Al-1.2Ti-0.05C-0.003B-Bal. Ni. The heat treatments were carried out under the respective conditions as follows: 1150° C.×2 h for the solution heat treatment, 950° C.×5 h for the carbide stabilizing treatment, 750° C.×16 h for the first aging treatment, and 650° C.×24 h for the second aging treatment.

Whereas, the chemical composition of the alloy of the photograph of FIG. 2B is also the same chemical composition of that of the photograph of FIG. 2A. The heat treatment was carried out in the following manner. A solution heat treatment was carried out at 1150° C.×2 h. Then, a carbide stabilizing treatment by furnace cooling was carried out. Subsequently, the first aging treatment and the second aging treatment were carried out.

Herein, the conditions for the first aging treatment, and the conditions for the second aging treatment are the same as those for the photograph of FIG. 2A.

Further, the chemical composition of the alloy of the photograph of FIG. 2C is also the same chemical composition as those for the photographs of FIGS. 2A and 2B, and the heat treatment was carried out in the following manner. A solution heat treatment was carried out at 1100° C.×2 h. Then, without carrying out a carbide stabilizing treatment, the first aging treatment and the second aging treatment under the same conditions as described above were carried out.

As apparent from these photographs, the following is discernible: the ones subjected to the carbide stabilizing treatment are different in the grain boundary form from the ones not subjected to the same treatment, and a aggregated carbide is formed along the grain boundaries there, so that the grain boundaries is a zigzag form.

While the present invention has been described in detail and with reference to specific embodiments thereof, it will be apparent to one skilled in the art that various changes and modifications can be made therein without departing the spirit and scope thereof.

The present application is based on Japanese Patent Application No. 2004-132135 filed on Apr. 27, 2004, and the contents thereof are incorporated herein by reference.

What is claimed is:

1. A method for producing a forged low thermal expansion Ni-base superalloy with a high creep fracture strength, the superalloy comprising a nickel containing γ' phase, a nickel containing $A_2B$ phase and, as a matrix, an austenite phase wherein Ni is the main component and Mo, W and Re are solid-solved therein, and a carbide phase in the form of aggregated carbides on grain boundaries, said method comprising:

preparing an alloy comprising, by weight %,

C: 0.02 to 0.15%,

Si: 1% or less,

Mn: 1% or less,

Cr: 5 to 20%, at least one of Mo, W and Re, which satisfy the relationship Mo+½(W+Re): 17 to 27%, Al: 0.1 to 1.22%, Ti: 0.1 to 2%, Nb and Ta, which satisfy the relationship Nb+Ta/2: 1.5% or less, Fe: 10% or less, Co: 5% or less, B: 0.001 to 0.02%, Zr: 0.001 to 0.2%, a remainder of Ni and inevitable components;

subjecting the alloy to a solution heat treatment under the condition of at a temperature of 1000 to 1200° C.;

subjecting the alloy to either a carbide stabilizing treatment to form the aggregated carbides on grain boundaries and to stabilize the aggregated carbides under the conditions of at a temperature of not less than 850° C. and less than 1000° C. and for 1 to 50 hours, or a carbide stabilizing treatment to form the aggregated carbides on grain boundaries to stabilize the aggregated carbides by cooling from the temperature in the solution heat treatment to 850° C. at a cooling rate of 100° C. or less per hour;

subjecting the alloy to a first aging treatment to precipitate the γ' phase under the conditions of at a temperature of 720 to 900° C. and for 1 to 50 hours; and subjecting the alloy to a second aging treatment to precipitate the $A_2B$ phase under the conditions of at a temperature of 550 to 700° C. and for 5 to 100 hours.

2. The method of claim 1 wherein the alloy is subjected to a carbide stabilizing treatment to form the aggregated carbides on grain boundaries and stabilizing the carbides under the conditions of a temperature of not less than 850° C. and less than 1000° C. for 1 to 50 hours, and the solution heat treatment is from 1050° C. to 1150° C.

3. The method of claim 1 wherein the alloy is subjected to a carbide stabilizing treatment to form the aggregated carbides on grain boundaries and stabilizing the carbides by cooling from the temperature in the solution heat treatment to 850° C. at a cooling rate of 100° C. or less per hour, and the solution heat treatment is from 1050° C. to 1150° C.

4. The method of claim 1 wherein the alloy has enhanced creep rupture strength under high temperature.

5. The method of claim 1 wherein the carbon content is from 0.02 to 0.10.

6. The method of claim 1, wherein the alloy contains Mo.

7. A method for producing a forged low thermal expansion Ni-base superalloy with high creep fracture strength, the superalloy comprising an nickel containing γ' phase, a nickel containing $A_2B$ phase and, as a matrix, an austenite phase wherein Ni is the main component and Mo, W and Re are solid-solved therein, and a carbide phase in the form of aggregated carbides on grain boundaries, said method comprising:

preparing an alloy comprising, by weight %,

C: 0.02 to 0.15%,

Si: 1% or less,

Mn: 1% or less,

Cr: 5 to 20%, at least one of Mo, W and Re, which satisfy the relationship Mo+½(W+Re): 17 to 27%, Al: 0 to 1.22%, Ti: 0.1 to 2%, Nb and Ta, which satisfy the relationship Nb+Ta/2: 1.5% or less, Fe: 10% or less, Co: 5% or less, B: 0.001 to 0.02%, Zr: 0.001 to 0.2%, a remainder of Ni and inevitable components;

subjecting the alloy to a solution heat treatment under the condition of at a temperature of 1000 to 1200° C.;

subjecting the alloy to a carbide stabilizing treatment to form the aggregated carbides on grain boundaries and to stabilize the aggregated carbides under the conditions of at a temperature of not less than 850° C. and less than 1000° C. and for 1 to 50 hours, subjecting the alloy to a first aging treatment to precipitate the γ' phase under the conditions of at a temperature of 720 to 900° C. and for 1 to 50 hours; and subjecting the alloy to a second aging treatment to precipitate the $A_2B$ phase under the conditions of at a temperature of 550 to 700° C. and for 5 to 100 hours.

8. The method of claim 7, wherein the alloy has enhanced creep rupture strength under high temperature.

9. The method of claim 7 wherein the carbon content is from 0.02 to 0.10.

10. The method of claim 7, wherein the carbon content is from 0.02 to 0.10.

11. The method of claim 7, wherein the alloy contains Mo.

12. A method for producing a forged low thermal expansion Ni-base superalloy with high creep fracture strength, the superalloy comprising a nickel containing γ' phase, a nickel containing $A_2B$ phase and, as a matrix, an austenite phase wherein Ni is the main component and Mo, W and Re are solid-solved therein, and a carbide phase in the form of aggregated carbides on grain boundaries, said method comprising:

preparing an alloy comprising, by weight %,

C: 0.02 to 0.15%,

Si: 1% or less,

Mn: 1% or less,

Cr: 5 to 20%, at least one of Mo, W and Re, which satisfy the relationship Mo+½(W+Re): 17 to 27%, Al: 0.1 to 1.22%, Ti: 0.1 to 2%, Nb and Ta, which satisfy the relationship Nb+Ta/2: 1.5% or less, Fe: 10% or less, Co: 5% or less, B: 0.001 to 0.02%, Zr: 0.001 to 0.2%, a remainder of Ni and inevitable components;

subjecting the alloy to a solution heat treatment under the condition of at a temperature of 1000 to 1200° C.;

a carbide stabilizing treatment to form the aggregated carbides on grain boundaries and to stabilize the aggregated carbides by cooling from the temperature in the solution heat treatment to 850° C. at a cooling rate of 100° C. or less per hour, subjecting the alloy to a first aging treatment to precipitate the γ' phase under the conditions of at a temperature of 720 to 900° C. and for 1 to 50 hours; and subjecting the alloy to a second aging treatment to precipitate the $A_2B$ phase under the conditions of at a temperature of 550 to 700° C. and for 5 to 100 hours.

13. The method of claim 12, wherein the alloy has enhanced creep rupture strength under high temperature and contains Mo.

14. The method of claim 13 wherein the carbon content is from 0.02 to 0.10.

* * * * *